United States Patent [19]

Ali

[11] Patent Number: 4,617,767

[45] Date of Patent: Oct. 21, 1986

[54] SANDING, BUFFING AND POLISHING TOOL AND PARTS THEREOF

[76] Inventor: Frank F. Ali, 2855 Locke Dr., Beavercreek, Ohio 45324

[21] Appl. No.: 691,018

[22] Filed: Jan. 14, 1985

[51] Int. Cl.[4] ..... B24D 17/00

[52] U.S. Cl. ..... 51/358; 51/406

[58] Field of Search ..... 51/358, 376, 407, 406

[56] References Cited

U.S. PATENT DOCUMENTS

| | | | |
|---|---|---|---|
| 2,581,567 | 1/1952 | Wiley | 51/407 |
| 3,082,582 | 3/1963 | Jeske | 51/407 |
| 3,510,992 | 5/1970 | Hutchins | 51/358 |
| 3,522,681 | 8/1970 | Lampert | 51/358 |
| 3,823,516 | 7/1974 | Christian | 51/358 |
| 4,222,204 | 9/1980 | Benner | 51/376 |
| 4,263,755 | 4/1981 | Globus | 51/358 |
| 4,322,920 | 4/1982 | Wells | 51/376 |

*Primary Examiner*—Harold D. Whitehead
*Attorney, Agent, or Firm*—Jerome P. Bloom

[57] ABSTRACT

A sanding, buffing and polishing tool per the invention includes a pad affording means for the mount of an abrasively surfaced device utilizing a hook and loop type fastener structure or its equivalent for their interconnection. The pad in its preferred embodiment comprises a front face and a rear face with the major portion of the front face being essentially planar in configuration and the plane thereof perpendicular to the axis of rotation of the pad. Said major portion of the front face is inset or recessed relative an annular portion thereof which is defined by the projected extremity of a relatively narrow cylindrical wall structure which is generally perpendicular to the plane of said major portion and defines therewith a shallow cavity. The hook portion of the hook and loop fastener is securely fixed over and coextensively with said major portion of the front face of the pad to nest essentially within the limits of said cavity and the axial extent of said cylindrical wall structure. The annular and the said major portion of the front face are in substantially parallel planes. A drive shaft connected to define the axis of rotation of said pad has one end portion thereof lodged and anchored within the body of said pad, short of its front face thereof and its opposite end portion projected from the rear face of the pad.

9 Claims, 6 Drawing Figures

SANDING, BUFFING AND POLISHING TOOL AND PARTS THEREOF

BACKGROUND OF THE INVENTION

This invention relates to improvements in tools which comprise a shaft connected with and projected from one face of a pad or disc the opposite face of which mounts an abrasively surfaced sanding, buffing or polishing device by means of interposed sheet material defining a releasable fastener one element of which is secured to the pad and the other element of which is secured to the back of the sanding, buffing or polishing device, the fastener being of a hook and loop type, such as Velcro or its equivalent. The invention provides improvements in (a) the means and the manner in which the shaft is interconnected with the pad, by virtue of which to insure a continuing, positive and uniform drive thereof in rotation, (b) the construction of the pad, which affords a more positive, more satisfactory and more durable mount thereto of that abrasively surfaced device which is selected to provide the working face of the tool so comprised and (c) the character and manner of interrelation with the pad of that portion of the fastener which is secured thereto, the net result of which is the achievement of a sanding, buffing and polishing tool which is simply constructed and most efficient and easy to use.

Prior art tools such as those with which the present invention is concerned have evidenced a number of problems in their use, which problems become particularly obvious where the application of the tool requires a high speed of its rotation. Such problems, which derive to a considerable extent from the degree of the pressure and torsional stress developed in use of the tools, include the following:

(a) hook portions of the sheet material providing one element of the fastener which forms a releasable connection of the abrasively surfaced working device to the pad become so embedded in the material in the second element of the fastener, to which they connect, as to make the abrasively surfaced device difficult to remove from the pad when its replacement is required or desired, (b) the inherently developed pressure and torsional forces result in such a bending and stressing of the aforesaid hook portions, in tension, as to fatigue the hook portions and at the same time diminish their value as connector elements, (c) under such conditions as set forth in subparagraph (b) immediately above, the portions of the material in which the hook elements engage are so strained, distorted and/or broken as to the diminish the value thereof in achieving the connection required between the abrasively surfaced working medium and the pad, as a consequence of which there is a radial shifting of the working medium relative the pad and/or a "walking" of the tool, making it difficult to satisfactorily perform therewith a sanding, buffing or polishing function, (d) the wear and tear on the abrasive surface of the working medium is often such as to consequentially induce such weakness in and/or distortion of the fastener sheet materials as to necessitate a frequency of replacement of parts much greater than normal, increasing beyond a reasonable level the time and/or cost of performing the required sanding, buffing or polishing of a work surface or surfaces, (e) the connection between the pad and the shaft through which it is driven loosens, as a consequence of which a satisfactory sanding, buffing or polishing of a work surface becomes quite difficult to achieve in any reasonable degree of time.

As those versed in the art will fully understand, the primary area of use of the abrasive surface of the device providing the working medium mounted to the pad will be in a location adjacent the outer peripheral edge of its working face. Considering further that the hook and loop connector portions of the tools of the prior art with which we are here concerned include portions thereof sandwiched between the abrasively surfaced device and the front face of the pad which they overlie, one can comprehend the seriousness of the problems of the prior art to which the present invention is directed.

The present invention deals with and overcomes the above mentioned problems in a very positive manner. The improvements which are comprised therein which lend themselves to the solutions of the problems will be illustratively described herein with particular reference to the embodiment thereof in which the pad and the abrasively surfaced sanding, polishing and buffing mediums applied thereto each has a disc form and the means defining the interconnection of the abrasively surfaced device to the pad define a hook and loop type releasable fastening of one thereof to the other. While so illustrated, neither the specific form nor the application thereof herein demonstrated should be construed as limiting since such is obviously not intended.

As far as those substantively involved in this disclosure, the following U.S. Patents and foreign publications represent the general state of the prior art of which they are aware, the same having been determined in the course of an extensive search of the records of the U.S. Patent and Trademark Office:

| Country | No. | Date | Inventor |
|---|---|---|---|
| U.S. | 3,302,232 | Feb. 7, 1967 | T. J. Wasiloff et al |
| U.S. | 3,346,904 | Oct. 17, 1967 | William F. Armstrong |
| U.S. | 3,522,681 | Aug. 4, 1970 | G. Lampert |
| U.S. | 3,527,001 | Sept. 8, 1970 | R. H. Kleemeier et al |
| U.S. | 3,703,739 | Nov. 8, 1972 | Young et al |
| U.S. | 4,437,269 | Mar. 20, 1984 | George Shaw |
| England | 1,126,136 | Sept. 5, 1968 | |
| Swiss | 446,105 | Oct. 31, 1967 | |

It does not appear that any one of these foregoing publications has specific pertinence to the novel features of the invention or sets forth any pertinence beyond that which is first defined in this disclosure as comprising a tool to which the improvements of the present inventon are directed.

SUMMARY OF THE INVENTION

Embodiments of the present invention feature a uniquely constructed pad affording a substantially improved mount of an abrasively surfaced element utilizing a hook and loop type fastener structure or its equivalent for their firm but quickly releasable interconnection. The major portion of the outer or front face of the pad, which is preferably essentially planar and in a plane perpendicular to its axis of rotation, is inset or recessed relative an annular portion thereof which projects forwardly therefrom and substantially perpendicular thereto. The projected extremity of said annular portion is preferably substantially flat and in a plane which is essentially parallel to the planar surface of the inset or recessed portion. In the preferred embodiment herein illustrated it will be seen that the depth of projection of said annular portion and the longitudinal or axial extent thereof is quite shallow. The front face of the pad is thereby provided with a shallow cylindrical cavity adhesively fixed to and substantially coextensive with the base of which is a sheet of material that emboies a multitude of outwardly projected hooks. These hooks are limited as to their axial extent and preferably do not appreciably project beyond the projected extremity of the annular portion of the front face of the pad to which the sheet material embodying the hooks is secured. The diameters of the inner and outer limits of the annular projected portion of the front face of the pad will be selected, in any given instance, to underlie the working portion of the abrasively surfaced device to be applied in overlying relation to the pad.

In accordance with the illustration of the present invention, the abrasively surfaced device will comprise a sheet of material the outer or working face of which embodies abrasive elements the form, amount and size as well as disposition of which will depend on whether its application is for a sanding, buffing or polishing function. Its rear surface will have adhesively secured in backing relation thereto a sheet of a textile type material the form of which provides, in the application of the abrasively surfaced device over the pad, a multitude of loops to be interengaged by the aforesaid hook elements as the loop material is brought into a pressured contact therewith. The arrangement here provided affords a construction wherein the projected annular rim of the front face of the pad constitutes a relatively firm though somewhat resilient bearing surface which absorbs and disseminates the principal portion of the load and stress applied to and through the abrasively surfaced medium in a direction to substantially relieve the amount of pressure and stress which is applied directly to the hook and loop material in the use of a tool of the type described. The net result is a much longer life for the hook and loop type or equivalent material utilized, making it virtually indestructable in any relatively short period of time.

A feature of the most preferred embodiments adds to the foregoing the benefits of a lightweight plastic disc per the present invention which embodies in integrated connection therewith an improved shaft. A head formed integral with the one end portion of said shaft which is lodged in the body of the disc is stepped and includes in the most radially projected portion thereof a pie shaped or equivalent notch. The form of this head enables a firm lock of the shaft to the body of the disc as the plastic material of the disc is molded thereabout and cured. The net result is that the disc per se embodies a shaft a portion of which projects rearwardly thereof to facilitate the firm and secure chucking thereof to a power tool, through the medium of which the disc and its mounted elements may be rotated at any selected level of speed within the capability of the tool and afford thereby a sanding, buffing or polishing tool embodying the several benefits of the present invention.

A primary object of the invention is to provide improvements in sanding, buffing and polishing tools which comprise a shaft connected with and projected from one face of a pad the opposite face of which mounts an abrasively surfaced sanding, buffing or polishing medium by means by of interposed material which provides a hook and loop or equivalent type releasable interconnection thereof rendering such a tool easy and economical to fabricate, more efficient and satisfactory in use, adaptable to a wide variety of applications and unlikely to malfunction.

A further object of the invention is to provide an improved pad for use in mounting an abrasively surfaced device utilizing hook and loop sheet materials for the interconnection thereof and the secure mount of the abrasively surfaced medium with good function thereof even under the conditions of such pressure and stress as that to which it is subjected during a high speed of its rotation in its application to a work surface.

An additional object of the invention is to provide improvements in sanding pads or discs which may be utilized to mount an abrasively surfaced medium affording an improved interconnection thereto and integration therewith of a drive shaft.

A further object of the invention is to provide improved means and methods of mounting abrasively surfaced mediums to a pad or disc enabling a more effective utilization of a quick release interconnecting means therebetween in the nature of hook and loop type sheet materials such as exemplified by Velcro.

An additional object of the invention is to provide a new and improved sanding, buffing and polishing tool, and parts thereof, possessing the advantageous structural features, the inherent meritorious characteristics and the means and mode of use thereof such as those herein described.

With the above and other incidental objects in view as will more fully appear in the specification, the invention intended to be protected by Letters Patent consists of the features of construction, the parts and combinations thereof, and the mode of operation as hereafter described or illustrated in the accompanying drawings, or their equivalent.

Referring to the accompanying drawings wherein one but not necessarily the only form of embodiment of the invention is illustrated, FIG. 1 is a perspective of an exploded view of a preferred embodiment of the invention;

Like parts are indicated by like numerals throughout the accompanying drawings.

Figure 1:
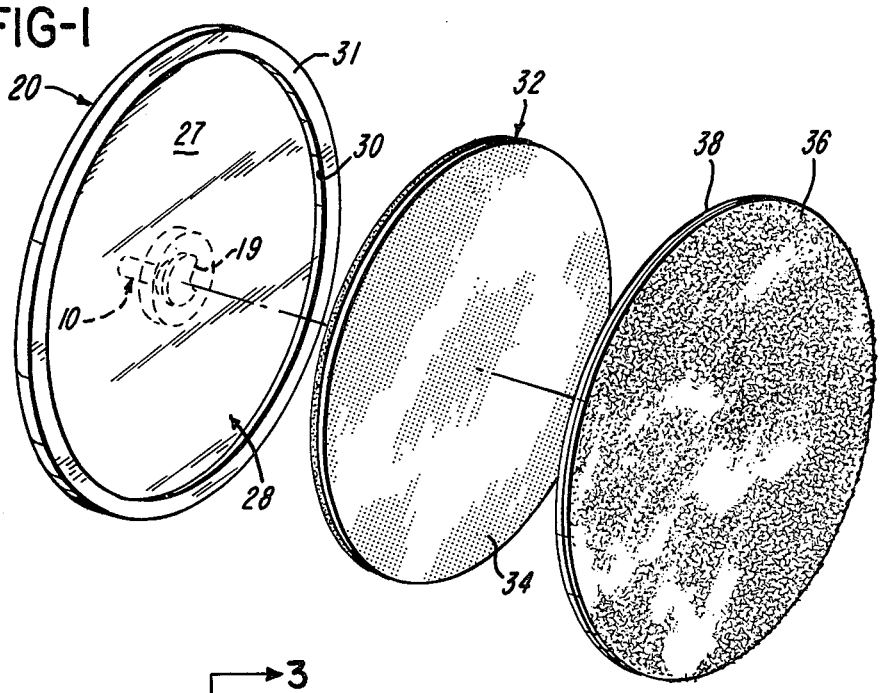
Figure 2:
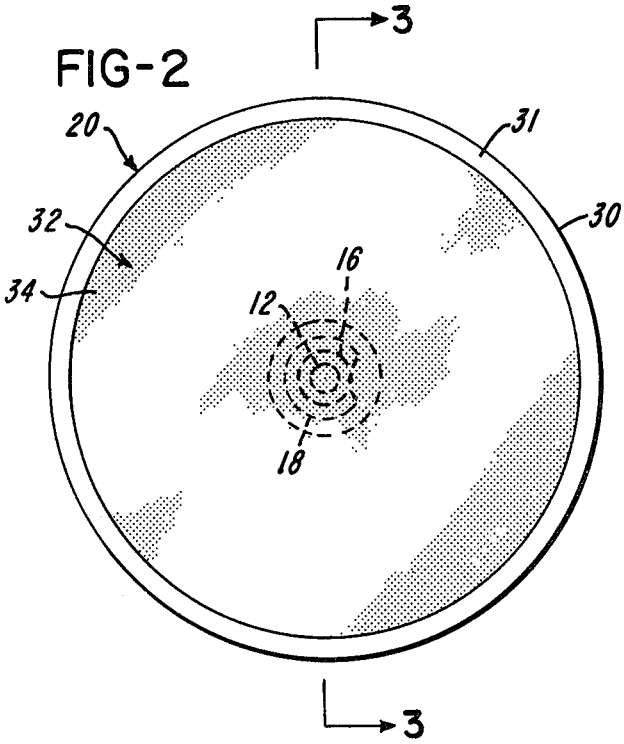
FIG. 2 is a plan view of the pad of FIG. 1 which embodies in connection therewith an integrated shaft by means of which it may be driven and the hook portion of the hook and loop sheet material serving as a fastener in the tool illustrated.

The embodiment of the present invention herein illustrated, by way of example but not by way of limitation, comprises a relatively short shaft 10 including a uniform relatively small diameter, rod-shaped body portion 12 which defines the major portion of its length and extends from, perpendicular to and coaxially with an enlarged head portion 14. The shape of the head portion 14 provides the shaft with two brief segments of its length, respectively 16 and 18, each successively having a larger diameter than the preceding segment or portion of the shaft.

The segment 18 which defines one end 17 of the shaft 10 has a plate-like configuration, exhibits its largest diameter and in that portion which extends radially outward of the preceding shaft segment 16 has a substantially radially oriented pie shaped notch 19 and the apex of which, in this instance, is innermost. The stepped diameter of the shaft head portion 14 produces thereon successive annular shoulders which are parallel and concentric with, perpendicular to and face in the direction of the remote end 13 of body portion 12.

The pad of the illustrated embodiment is a disc element 20 which is molded of polypropylene. The head portion 16, 18 of the shaft 10 is locked within the disc 20, at its center, while the major extent of its body portion 12 is projected outwardly of, rearwardly from and perpendicular to what may be considered the rear face 24 of the disc, at its center. As so applied, the shaft 10 is integrated with and defines the axis of rotation of the disc 20.

The outer peripheral edge portion of the disc 20 is formed on an essentially uniform radius and is immediately backed and reinforced by an annular bead 33 defining a projection from the outer peripheral portion of the disc face 24. Central to the rear face 24 is a short, somewhat cylindrical projection 26, imposed on the body of the disc in the molding and curing thereof as the polypropylene material forms an encapsulating tight layer thereof about and to the rear of the head portion 16, 18 of the shaft 10 and to the rear of its annular shoulders. At the same time a portion of the polypropylene material is wedged in the notch 19. By reason of this construction, the shaft and the disc are so fixedly interconnected as to prevent relative rotative, axial or lateral movement therebetween.

An annular portion 25 of the rearmost surface of the projection 26 is recessed and serves to provide, as should be obvious from the drawings, a protective abutment surface insuring the proper alignment of the shaft as the projected part of its body portion 12 is chucked to a power tool for drive thereof, and thereby of the disc 20, as and when required.

Attention is directed to the fact that, by virtue of the cross section of the pad 20 and the material thereof, the body of the pad from its center for a distance of about two thirds of its radial extent is substantially resistant to bending or flexing. The outer third of the radial extent of the disc, which is thin from front to rear, as is the part immediately inward thereof which rims its central portion including the projection 26, is provided with a limited flexibility sufficient only to enable a balanced flexing of that limited portion thereof which normally, in any given instant, backs the working surface portion of the tool of which it forms a part. By virtue of an annular portion 30 at the outer peripheral limit of the disc, to be further described, the entire structure of the disc is provided with substantial strength and resistance to deterioration or damage in use.

The front face 28 of the disc 20 is centrally recessed to provide therein a shallow cavity the base 27 of which is bounded by a forwardly and outwardly projected generally cylindrical wall surface 30. The front face 28 is thus comprised of that surface portion thereof represented by the base 27, which is substantially planar in configuration and represents the major extent of its area, and that relative small percentage of its area represented by the narrow annular surface portion 31 defined at the projected extremity of the wall structure 30. The surface portions 27 and 31 are in substantially parallel planes, both of which are essentially perpendicular to axis of rotation of the disc 20.

Figure 3:
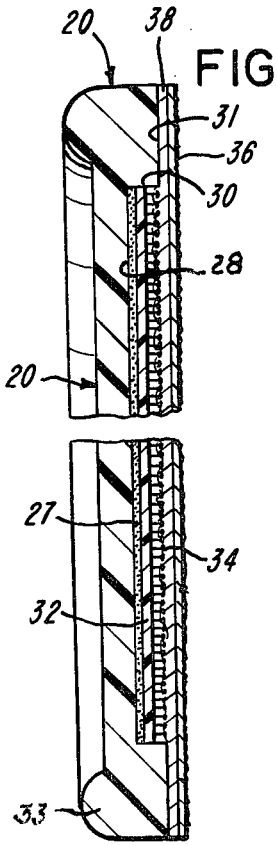
FIG. 3 is an enlarged cross sectional view taken on line 3—3 of FIG. 2, the central portion of which has been omitted for clarity of disclosure.
Figure 4:
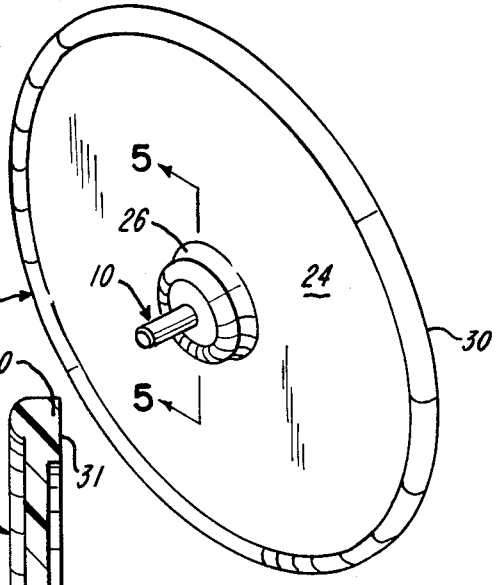
FIG. 4 is a perspective view of the pad of FIG. 2, taken from the rear thereof.
Figure 5:
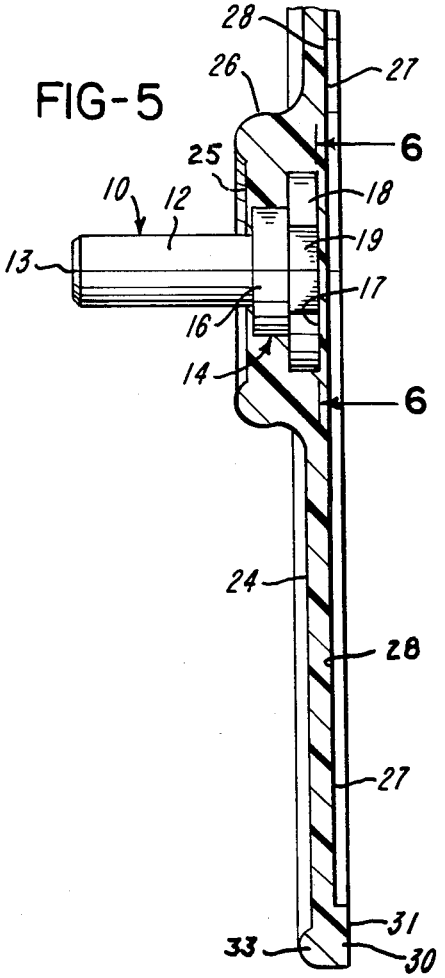
FIG. 5 is a cross sectional view taken on line 5—5 of FIG. 4.
Figure 6:
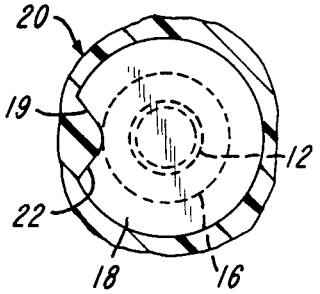
FIG. 6 is a sectional view taken on line 6—6 of FIG. 5.

A sheet 32 of hook material serving as one half of what is generally described as a hook and loop textile type fastener is permanently fixed, by adhesive, on and coextensively with the surface of the base 27 of the shallow cavity defined in the front face 28 of the disc 20. As herein illustrated, the sheet material 32 comprises a base sheet structure from the outermost surface of which projects a multitude of very small hooks 24 arranged in closely spaced relation and in parallel, closely spaced rows. These hooks are of the type wherein each is comprised of a stem anchored at its base to the underlying base sheet structure of which it forms a part to project outwardly therefrom and perpendicular thereto and have a head formed on its outer end which resembles the head of a mushroom. Per the present invention the thickness of the sheet material 32 including the axial extent of its hooks 34 is limited to provide that the hooks do not appreciably project beyond the axial limit 31 of the bounding wall structure 30. As most preferred, illustrated in FIG. 3, the projected limits of the hooks 34 should be at or slightly to either side of the plane of the annular surface 31.

To convert the pad so formed to a tool assembly such as required to achieve a particular sanding, buffing or polishing function requires only the selection of the type and grade of an abrasively surfaced material best suited for the work to be performed. In the example illustrated the selected material is exemplified by a disc the outer or working face of which is surfaced by an abrasive sanding material 36 and the back or rear face of which has a sheet of loop material securely fixed coextensively therewith, in backing relation thereto. The diameter of the working disc assembly 36, 38 so comprised should not be less and preferably should be somewhat more than that of the disc 20, over the front face of which it mounts to provide a working tool assembly per the present invention.

The simplicity, effectiveness and desirability of the features of improvement provided by embodiments of the present invention as herein illustrated by way of a preferred example should be self evident.

In the application of the disc assembly 36, 38, on the centering of its loop material 38 immediately over, on and in bridging relation to the front face of the disc 20 including its annular surface 31, which is in this case essentially flat and smooth, and pressing the disc assembly 36, 38 inwardly, within the limits bounded by the wall structure 30, one can easily and quickly achieve a firm and positive interconnection between the hooks 34 and loops of the sheet material 38. This in turn establishes a secure though readily releasable connection as between the disc 36 and the pad 20.

Thus, the outer peripheral portion of the loop material 38 bears on and is firmly backed by the surface 31 of the wall structure 30 for working purposes. Since the overlying area of the abrasive surface of the sanding disc 36, which is that area thereof normally used for sanding, buffing and polishing, is now firmly backed, with a total absence of hooks between it and the portion of the disc by which it is backed, the disc assembly 36, 38 can be most effectively used for an extended period of time and with optimal efficiency, even with a high speed of its rotation. By reason of the construction here provided one can easily and quickly lift and separate the working disc assembly 36, 38 following a working session. Moreover, damage to either the working disc assembly or unreasonable wear or speed of wear of its working surface is obviated. At the same time damage to the backing surfaces of the pad including the hooks of the fastener portion which it embodies are essentially obviated. It should be readily apparent therefrom that the invention apparatus inherently solves the aforementioned problems of the prior art. At the same time the nature of the backing and manner in which the backing for the primary working area of the abrasively surfaced disc is provided concentrates the force applied through the pad and makes the tool assembly more effective and efficient in use and easier to control. In addition to this, that portion of the working disc overlying that area within the boundary of the wall structure 30 is, by virtue of the recessing of the surface 27, adapted to resiliently give, thereby also facilitating a fine control of the work surface which obviates or renders minimal the risk of serious inadvertent damage to the work surface to which the tool utilizing the pad and pad assembly of the invention is applied.

Most importantly the construction just described protects and relieves the hook and loop connector material of the undesirable degree of pressure and torsional stress to which the same are frequently subjected in using sanding, buffing and polishing tools per the prior art.

The benefits of the invention and the solutions of the various prior art problems which it achieves should now be clear.

It should be understood that by referral herein to hook and loop material fasteners, such reference is intended to include hook and loop fasteners, those known as Velcro fasteners and for that matter other fasteners of similar nature provided they are presented in a form and relation as comprehended by the applications of the present invention.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A sanding, buffing and polishing tool comprising a pad having front and rear faces, a relatively narrow surface portion of the front face of which serves to mount in overlying relation thereto a working device having a front surface and a back surface, said front surface being abrasive to enable said device to serve a sanding, buffing and/or polishing function, said front face of said pad having a central recess the base of which has a substantially planar configuration, sheet material forming one part of a two part releasable fastener the other part of which is provided as a part of the abrasively surfaced device to be mounted to said front face of said pad, said sheet material being permanently secured to and substantially coextensive with said base of said central recess, the depth of said sheet material being limited so that it is not materially greater than that of said recess, said sheet material comprising a multitude of hook formations immediately of the opening to said recess, the portion of said pad which bounds said recess being constructed and arranged to project outwardly of and generally perpendicular to said base thereof and to define said relatively narrow surface portion of said front face which backs an outer peripheral portion of the back surface of said abrasively surfaced device, the other part of said releasable fastener being comprised of material anchored to said back surface of said device which bridges said opening to said recess and by virtue of a simple application of pressure to the central portion of said device within the limits of said relatively narrow surface which bounds said recess is securely hooked to said hook formations in an area immediately of said opening to said recess, said relatively narrow backing surface serving in the application of said apparatus to accomodate the load applied to said device in the use thereof to substantially relieve said releasable fastener of stress and pressure and inhibit the application of torsion thereto in the use of the tool of which they form a part.

2. Apparatus for use in providing a sanding, buffing and polishing tool comprising a disc forming a back-up pad for abrasively surfaced sheet material the outermost face of which presents a sanding, buffing and/or polishing surface, said disc having a front face and a rear face, said front face having the major extent of its surface recessed relative to a relatively narrow bounding outer peripheral portion thereof to define therein a central cavity having a base which is surfaced by material including outwardly directed hook formations projected to a location immediately of a plane defined by said relatively narrow bounding outer peripheral surface portion of said front face of said disc.

3. Apparatus as in claim 2 wherein said central cavity is rimmed by a very shallow generally cylindrical wall structure one end surface of which defines said relatively narrow bounding outer peripheral portion of said front face of said disc and said relatively narrow bounding outer peripheral portion of said front face of said disc lies in a plane which is substantially parallel to that of said base.

4. Apparatus as in claim 2 wherein said disc, for a distance of about two-thirds of its radial extent from its center, is substantially resistant to bending or flexing and about the outer third of the radial extent thereof is provided with a limited flexibility sufficient only to enable a balanced flexing of the outer peripheral portion thereof, a surface portion of which defines said relatively narrow bounding outer peripheral portion of said front face of said disc.

5. Apparatus as in claim 4 including a working disc having front and back faces, the front face of which is surfaced by an adhesive material and the back face of which is surfaced by loop material securely interconnected therewith, said working disc having a diameter substantially corresponding to and not less than that of the first said disc, said working disc being centered over said front face of the first said disc and in coaxial relation therewith to have the outer peripheral portion of its back face bear on said relatively narrow bounding outer peripheral portion of said front face of the first said disc and the portion thereof within said outer peripheral bearing portion, which is surfaced by said loop material, firmly and positively interconected with said hook formations which are projected to a location immediately of a plane defined by said relatively narrow bounding outer peripheral surface portion of said front face of the first said disc.

6. Apparatus as in claim 5 wherein said loop material is provided by a sheet thereof securely fixed coextensive with an abrasively surfaced sheet material which provides said front face of said working disc.

7. Apparatus as in claim 2 including a shaft having a relatively short rod-like configuration the diameter of which is stepped to produce thereon a radially enlarged head portion at one end thereof which comprises two brief segments of its length and forms thereon successive annular shoulders which are in close, axially spaced relation and perpendicular to the central axis of said shaft, said head portion being encapsulated by and lodged in the center of said disc while the remainder of said shaft projects outwardly from and perpendicular to said rear face of said disc to serve as means for the chucking of said disc to a power drive means for the rotation thereof by virtue to which to define the axis of rotation of said disc in use thereof, the construction and arrangement of the shaft and its application to said disc producing at the rear face of said disc an encapsulated central projecting providing a protective abutment surface insuring proper alignment of said shaft and orientation of said disc as said shaft is chucked to a power tool for a drive of said disc in use thereof.

8. Apparatus as in claim 7 wherein said head portion has a single substantially radial notch in its outer periphery in which material of said disc is lodged to prevent a relative rotation therebetween and said disc is characterized by the inner and the major portion of its radial extent being substantially resistant to bending or flexing and the remaining and radially outermost portion of its radial extent having a limited flexibility.

9. Apparatus as in claim 3 wherein said generally cylindrical wall structure, one end surface of which defines said relatively narrow bounding outer peripheral portion of said front face of said disc, has an axial extension which projects from and rearwardly of said back face of said disc and prevents uncontrolled bending and flexing of said disc at its outer periphery in use of said tool.

* * * * *

UNITED STATES PATENT AND TRADEMARK OFFICE

CERTIFICATE OF CORRECTION

PATENT NO. : 4,617,767

DATED : October 21, 1986

INVENTOR(S) : Frank F. Ali

It is certified that error appears in the above-identified patent and that said Letters Patent is hereby corrected as shown below:

Col. 2, line 55, "inventon" is corrected to read -- invention --.

Col. 5, line 63, "surface" is corrected to read -- structure --.

Col. 6, line 12, "24" is corrected to read -- 34 --.

Col. 8, line 61 (Claim 5, line 3) "adhesive" is corrected to read -- abrasive --.

Col. 9, line 25 (Claim 7, line 13) "to" (1st occurrence) is corrected to read -- of --.

Col. 10, line 4, (Claim 7, line 29) "projecting" is corrected to read -- projection --.

Signed and Sealed this

Third Day of February, 1987

*Attest:*

*Attesting Officer*

DONALD J. QUIGG

*Commissioner of Patents and Trademarks*